US009782655B1

(12) United States Patent
Novosel, Sr.

(10) Patent No.: US 9,782,655 B1
(45) Date of Patent: Oct. 10, 2017

(54) SPORTS WRIST TRAINER AND METHODS OF USE

(71) Applicant: John Michael Novosel, Sr., Leawood, KS (US)

(72) Inventor: John Michael Novosel, Sr., Leawood, KS (US)

( * ) Notice: Subject to any disclaimer, the term of this patent is extended or adjusted under 35 U.S.C. 154(b) by 0 days.

(21) Appl. No.: 15/437,200

(22) Filed: Feb. 20, 2017

Related U.S. Application Data

(63) Continuation-in-part of application No. 13/148,313, filed on Aug. 6, 2011, now abandoned.

(60) Provisional application No. 62/390,227, filed on Mar. 23, 2016.

(51) Int. Cl.
*A63B 69/36* (2006.01)
*A63B 69/00* (2006.01)

(52) U.S. Cl.
CPC ..... *A63B 69/36* (2013.01); *A63B 69/0002* (2013.01); *A63B 2069/0008* (2013.01); *A63B 2208/0204* (2013.01)

(58) Field of Classification Search
USPC ..... 473/231–233, 242, 295, 409, 524, 552, 473/558–568
See application file for complete search history.

(56) References Cited

U.S. PATENT DOCUMENTS 1,930,342 A * 10/1933 Graham ..... A63B 69/3632 473/232
4,249,762 A * 2/1981 Richards ..... A63B 15/00 473/256
4,367,871 A * 1/1983 Schiefer ..... A63B 49/035 403/294
4,555,111 A 11/1985 Alvarez
4,854,585 A 8/1989 Koch
5,205,561 A 4/1993 Lux
5,338,035 A 8/1994 Lyford
5,370,396 A * 12/1994 Bloom ..... A63B 69/3632 473/232
5,454,568 A * 10/1995 Richardson ..... A63B 69/3632 473/232
5,489,100 A * 2/1996 Potter ..... A63B 69/3632 403/104
5,516,097 A 5/1996 Huddleston
6,007,341 A 12/1999 Koch
6,257,992 B1 * 7/2001 LeBlanc ..... A63B 53/10 43/18.1 R
6,558,267 B2 5/2003 Novosel
6,569,042 B2 5/2003 LaChance
(Continued)

*Primary Examiner* — Nini Legesse
(74) *Attorney, Agent, or Firm* — Seth M. Reiss

(57) ABSTRACT

A sports wrist trainer comprising a first elongated swing member with grip attached to a second elongated swing member with head by means of a one way 90 degree hinge, and an elastic return means that returns and holds said swing members at a ninety degree angle one to the other. According to alternative embodiments, the wrist trainer is a bat used for learning batting swings or a golf club used for learning golf swings. The one way hinge rotates to provide a trainer having different swing configurations and to maintain the bat or club head facing the ball at impact just like at address. The elastic return means may be removed and the trainer used without it. A second one way 90 degree rotating hinge can be added to the first providing additional versatility and accommodating both right and left handed golfers.

20 Claims, 10 Drawing Sheets

(56) References Cited

U.S. PATENT DOCUMENTS

| | | | | |
|---|---|---|---|---|
| 7,235,024 | B2 * | 6/2007 | Lefebvre | A63B 15/00 473/457 |
| 7,625,295 | B2 * | 12/2009 | Gutierrez | A63B 53/00 473/219 |
| 2006/0199678 | A1 | 9/2006 | Benassi | |
| 2012/0034989 | A1 * | 2/2012 | Novosel, Sr. | A63B 15/00 473/242 |

* cited by examiner

Fig. 1
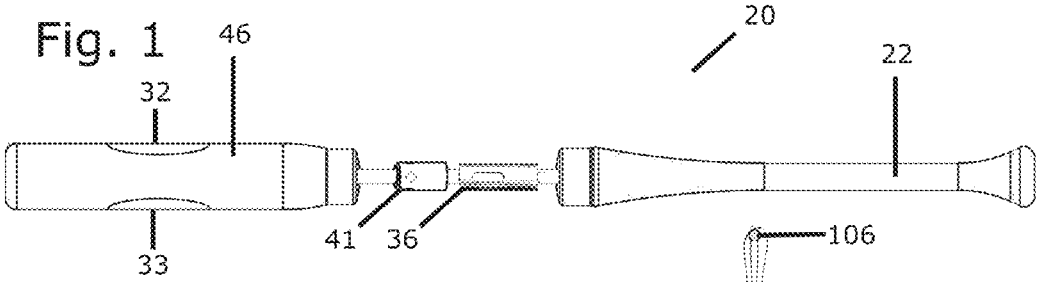
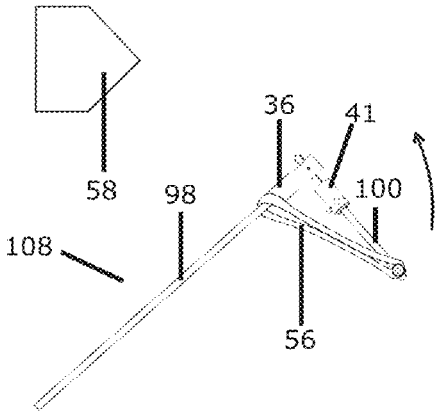
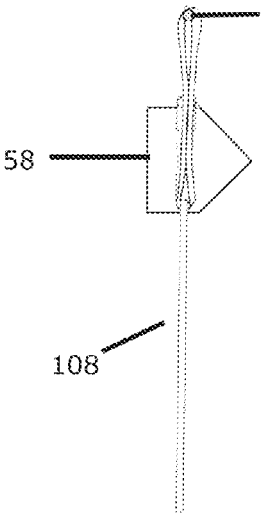
Fig. 3
Fig. 2
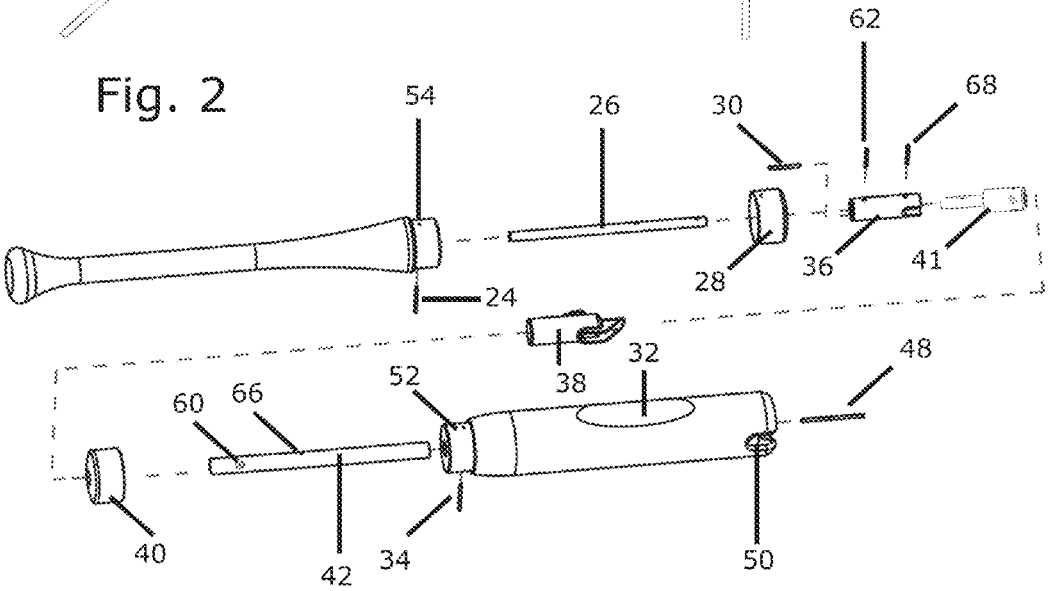
Fig. 4

Fig. 9
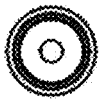
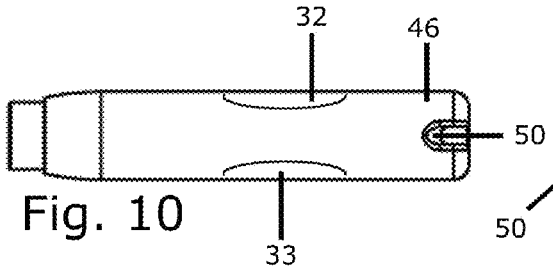
Fig. 10
Fig. 11
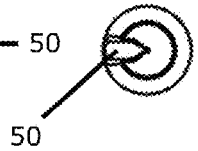
Fig. 12
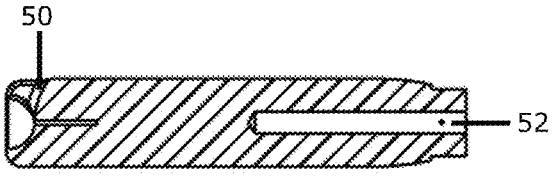
Fig. 13
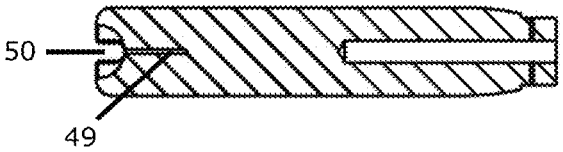
Fig. 14
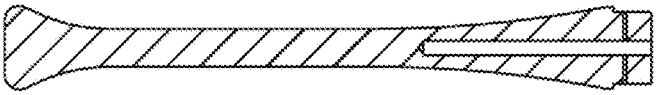
Fig. 15
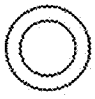
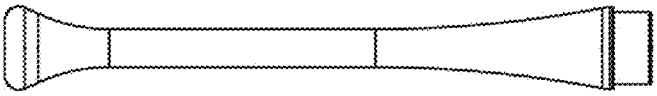
Fig. 17
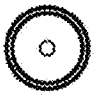
Fig. 16

Fig. 25
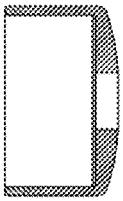
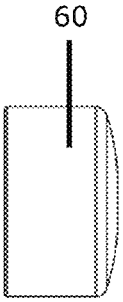
Fig. 26
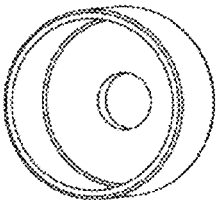
Fig. 27
Fig. 28
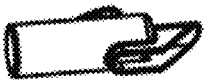
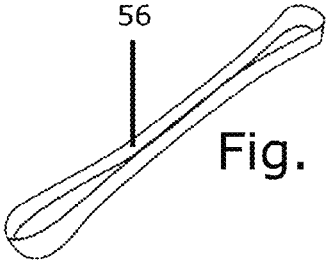
Fig. 29
Fig. 30
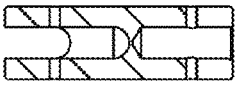
Fig. 32
Fig. 31
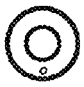
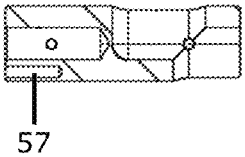
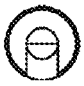
Fig. 33
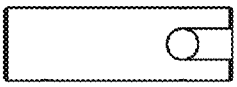
Fig. 34
Fig. 35
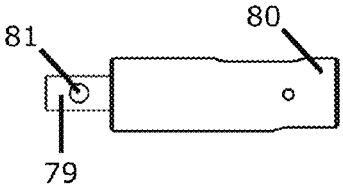
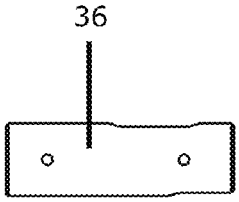
Fig. 36

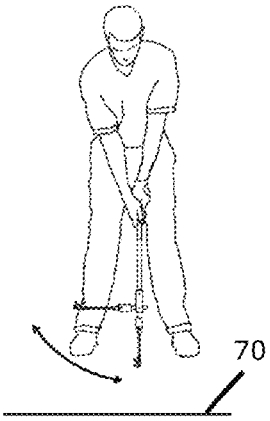
Fig. 42A
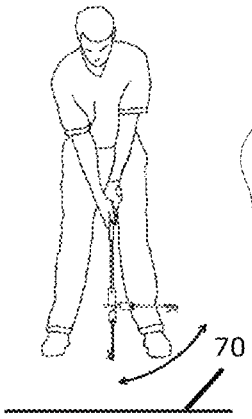
Fig. 42B
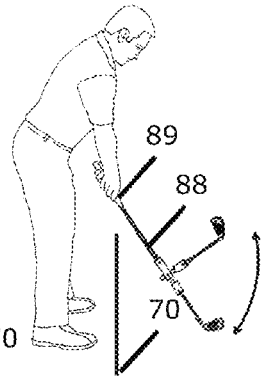
Fig. 42C
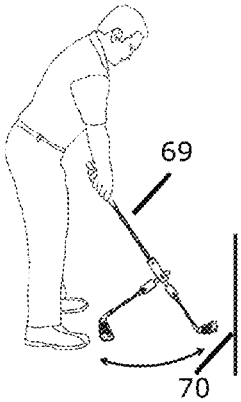
Fig. 42D
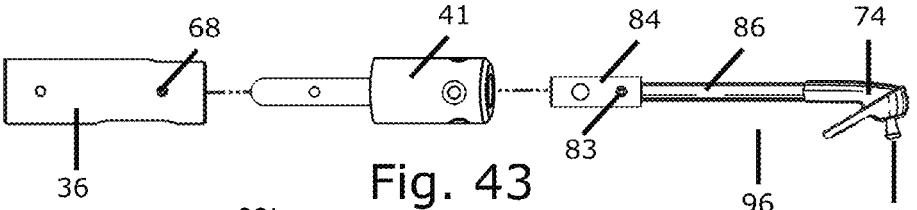
Fig. 43
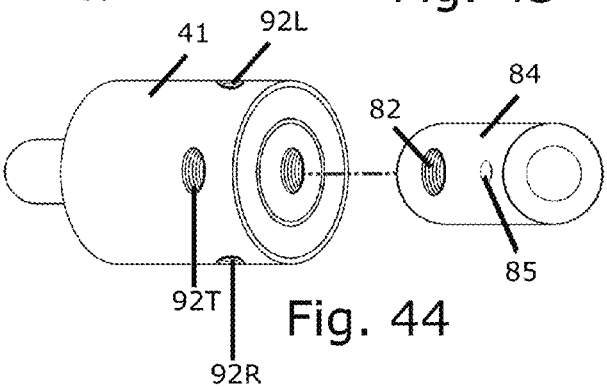
Fig. 44
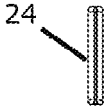
Fig. 45
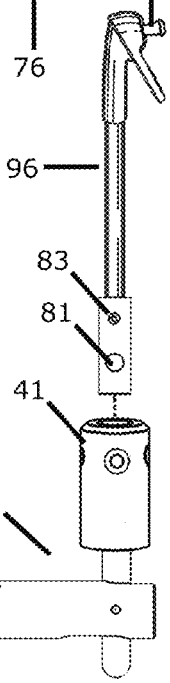
Fig. 46
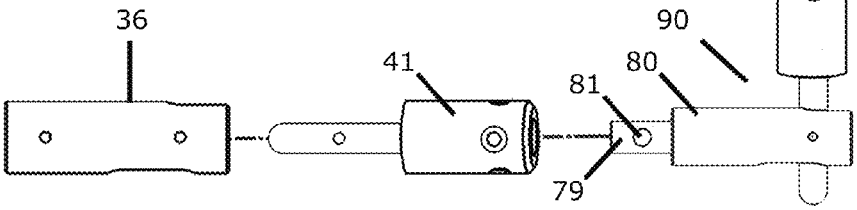

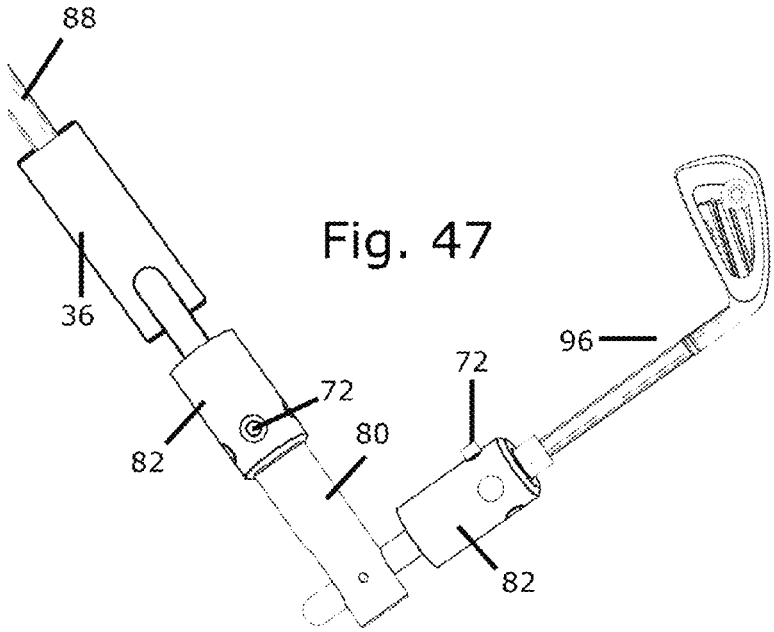
Fig. 47
Fig. 48A Fig. 48B Fig. 48C Fig. 48D
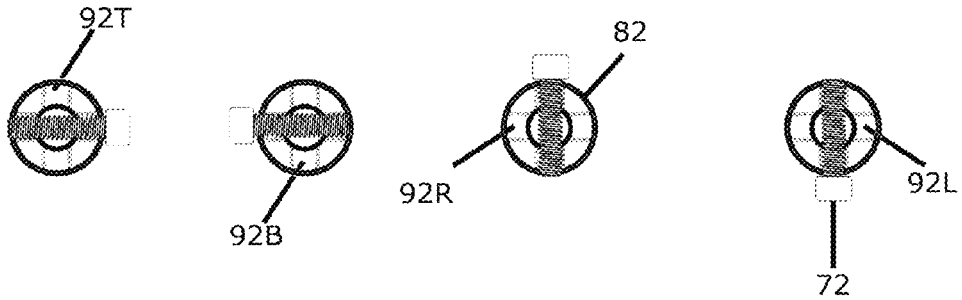
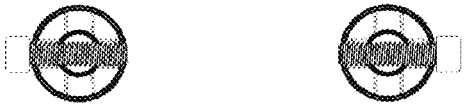
Fig. 49A Fig. 49B

SPORTS WRIST TRAINER AND METHODS OF USE

CROSS-REFERENCE TO RELATED APPLICATIONS

This U.S. Non-Provisional Utility patent application claims the benefit, under 35 U.S.C. §119, of United States Provisional Patent Application Ser. No. 62/390,227 filed Mar. 23, 2016 by the present inventor, and U.S. Non-Provisional patent application Ser. No. 13/148,313 filed Aug. 6, 2011, also by the present inventor, the contents of which are incorporated herein in their entirety.

STATEMENT REGARDING FEDERALLY SPONSORED RESEARCH

The invention described herein was not made pursuant to a government agency grant or contract. No government funds were utilized in the described invention.

FIELD OF THE INVENTION

This invention relates to sports training aids. More specifically, this invention describes a baseball/softball and golf swing training aid that promotes the correct use of the wrists in the swing and methods for using the training aid, and methods for using same.

BACKGROUND OF THE INVENTION

Through the years there have been many swing aids incorporating a hinged design as one of their features. In most of these designs, the hinge is of a fork type design; one hinge member has a pair of arms forming a fork, the other hinge member has a single arm (or tongue) which is received within the fork of the first member, while a pivot pin passes transversely through all three arms. These are easily constructed because the only stress vectors at the 90 degree angle are on the pivot pin and not on the forked sides. Examples of these are the Koch, U.S. Pat. No. 4,854,585, and Koch, U.S. Pat. No. 6,007,341. The inventor met Bob Koch in the 1990's when they both exhibited at the Orlando PGA show and at the ING conference at Hilton Head Island. The inventor was intrigued by Koch's version of a hinged training aid and even put Koch's original hinge on some of the inventor's products with good results.

The inventor then discovered in 2000 the tempo ratio of the tour pros and wrote the international bestselling book, Tour Tempo, published by Doubleday of New York in 2004. Because of the time frames involved in a tour pro's backswing, the inventor didn't want to concern himself about the hinge breaking in the backswing. Therefore, the inventor decided it would be more advantageous to have a hinged training aid that only hinged one way upwards at a ninety degree angle. Because of this, the inventor developed the invention described in Novosel, U.S. Pat. No. 6,558,267, which provided the aforementioned benefits but, of course, lacking the elastic member described below.

By accident, the inventor happened to revisit this invention after having some initial success with his students. The inventor had some of these clubs lying around against the wall one day when a magnetic scrap picker upper that he had ordered arrived at his home. He was planning to use the picker upper to pick up scrap parts of the golf shafts that he had cut for his various inventions. Reading the specifications for the picker upper it said that it had a 40 pound pull. Being by his practice clubs, the inventor decided to see if it would pull up the short end of the invention described in his Novosel, U.S. Pat. No. 6,558,267. Picking up the club and placing the magnetic end of the picker upper down by short portion of the club, the picker upper immediately pulled the hinge into a ninety-degree angle.

Seeing this, it occurred to the inventor that if there were a means to hold the shaft angle to ninety degrees and then release it, this might benefit his students by enabling them to experience and feel various important aspects of a true golf swing. It also occurred to the inventor it might be of substantial value to have a means to also allow the club shafts resume a straight line at impact from the ninety-degree angle and make the resistance variable to fit any type of golfer. Then, while using this new invention with a teen aged golfer, the young golfer went from shooting in the 90's before using practicing with the new invention to shooting in the 70's immediately after using it. Similarly, while using the new invention at the inventor's golf academies, all five adult students increased their drives by over 20 yards apiece The inventor next applied the subject invention to other sports, specifically softball and baseball. The golf wrist trainer was modified by designing a similarly hinged bat. This hinged bat was then used by an Olympian softball player with every student in her batting instruction business in Kansas City with excellent results.

It was subsequently discovered that the invention can be used in the four possible configurations described below, and each of the four configurations help the student improve his or her back-swing, transition, and impact with the ball.

SUMMARY OF THE INVENTION

The wrist swing training aid of the subject invention comprises a hinged practice device comprised of a first elongated grip member and a second elongated head member, and a removable elastic return means that allows the neophyte athlete to experience and feel what had here-to fore been one of the most difficult parts of the swing to master, namely, exactly how to use the wrists in the swing. In addition, this wrist swing training aid enables participants to practice their swings anywhere and at any time. And, when the removable elastic return means is taken off, the training aid can be used to hit balls on the baseball field or on the golf course.

The simplest and easiest way to accomplish the above-described objectives is to provide, for the elastic return means, rubber bands of varying resistance that can be selectively removed from the training aid. Bands of this type can be purchased from Alliance Rubber Company in Arkansas. Of course, equivalent means for elastically tethering the extended aspect of a bat or club include combinations of gears, springs, bungee cords, exercise tubing, sheeting or pneumatic apparatus or pulleys and wires or electro magnets, variable resistance linear position sensors and switches or electrical apparatus or any combinations of these that function to hold the hinge in a backwardly ninety degree angle and then smoothly release at impact with correct hinging of wrists and forearms through the swing and provide variable resistance for the user. A preferred embodiment employs rubber bands because of their relative simplicity and safety and because they give the exact the feel required to produce the desired results.

After trying this device with golfers, the inventor determined that it gave an entirely different feeling than anything that either they or the inventor have ever experienced from a training aid. The immediate results obtained from students convinced the inventor of the invention's utility. The subject invention immediately helped the students with one of the major mistakes that all amateurs make, namely, the use of the wrists in the golf swing. Once the students got the feeling of the correct use of the wrists in the golf swing, just about everything else in the swing worked itself out.

Most students take the club away too slow and do not swing it. The subject invention corrects this fault by making the golfer swing the club back. The golfer knows he or she is doing it right when the hinge straightens causing the shaft to straighten out and then re-hinges to its ninety degree angle at the top of the backswing. The feedback the invention provides with the transition is that when one gets to the top of the backswing, the elastic member causes it to snap to its ninety degree orientation. This snapping accentuates the feel of the movement and makes a sound when it happens. Once the student senses this action, that is their cue to return the club to impact with the ball. It also accentuates the feeling of when the release of the clubhead should occur during the downswing. All the user has to do to learn the previously arcane mechanical aspects of the swing is to swing the club back, hinge it and then swing it so that it straightens out at what would be impact with the ball and then re-hinge it again at the end of the follow through. This makes learning the mechanics of the golf swing incredibly simple in comparison to the contradictory, body position driven teaching of conventional golf instruction.

The inventor also discovered that by combining two hinges, for example the basic golf wrist hinge with another hinged attachment, the results obtained by using just one hinge are exponentially improved.

The preferred embodiment of the invention described and illustrated in this application comprises conventional baseball bat handles and baseball bat barrels, golf clubheads and training heads, shafts and hinges, and elastic return members that allow the golfer or batter to take off the elastic member and actually hit balls. The subject invention allows the player, in the context of golf, to transfer the feel of the hinging and unhinging of the shaft with the elastic return means on the club to the range and the golf course; or in the context of baseball, to transfer the feel of the hinging and unhinging of the bat barrel with the elastic return means to the being a batter in the game. The training aid and method of training using the aid makes it easy to accomplish one of the hardest parts of golf and batting, transferring the feel of practice to the course.

Another advantage of the current invention is that a distinctive sound made by the rubber bands when the shafts straighten out at impact. So it could be advantageous to incorporate, by way of a further embodiment, a sound producing device that increases or amplifies the sound that occurs when the shaft or bat is straightened.

Another option is to incorporate a light signaling device such as an LED that signals the user that the shaft or bat had gotten into a straightened position.

Another further option is incorporate a vibrational device, such as the buzzer on a cell phone or watch band, that signals the user that the shaft or bat had gotten into a straightened position. Or all three, sound and light and vibrational feedback means, could be combined to alert to the user when the shafts or bat sections assume a straightened mode.

The subject invention if notably different from currently available training aids. None of the prior art or commercially available sports wrist training aids with hinges are adjustable at one way ninety degree angles, have an elastic member that returns them to the original starting position, are rotatable to 360 degrees, or can be used with multiple training heads and/or clubheads, making the prior art training aids cost prohibitive to own if you had to buy all of training and clubheads.

Sports wrist training aids heretofore known suffer from a number of disadvantages, relative to the instant invention including:

(a) Prior art swing training aids do not have the option of multiple training heads and/or clubheads/barrels with the addition of a simple attachment.

(b) Prior art swing training aids do not have the option of another hinge attachment that fits into the original hinge member and gives the user additional multiple options.

(c) Prior art swing training aids are not adjustable to accommodate four different one way ninety degree angles.

(d) Prior art swing training aids do not have an elastic member that returns them to the original starting position.

(e) Prior art swing training aids are not readily usable by left or right handed batters/golfers with the addition of a simple attachment.

Accordingly several advantages of one or more aspects of the improved sports wrist trainer of the subject invention include:

(a) To provide an affordable sports wrist swing trainer with multiple hinge options that allow the trainer to be rotatable in four ninety degree increments, with training heads and/or bat barrels, that even though being rotated in four ninety degree angles are oriented to impact like a normal implement and have an elastic member that returns them to the original starting position;

(b) That can be used for sports that involve a swinging action, that are relatively inexpensive, and can be used to alternate between different training heads and/or bat barrels for use by left or right handed batters/golfers with the addition of a simple attachment.

Further objects, aspects and advantages of the instant invention will become apparent from consideration of the drawings and the ensuing description of exemplary embodiments of the invention. A person skilled in the art will realize that other embodiments of the invention are possible and that the details of the invention can be modified in a number of respects, all without departing from the concept, spirit and scope of the invention. Thus, the following drawings and description are to be regarded as illustrative in nature and not restrictive.

BRIEF DESCRIPTION OF THE DRAWINGS

FIG. 1 is a drawing of the baseball wrist trainer, showing the details of the front of the bat, taken from the view of a pitcher throwing to a right-handed batter, with the bat handle and bat barrel in a straight line over home plate.

FIG. 2 is a view showing the simplest manifestation of the device and how it would be one way hinged ninety degrees by the attached rubber band and used the same as the baseball wrist trainer in FIG. 5.

FIG. 3 is a view showing the simplest manifestation of the device and how it would be straightened by centrifugal force if used by a batter in the same manner as shown in FIG. 7.

FIG. 4 is a exploded view showing how the various components of the baseball wrist trainer fit together.

FIG. 9 is a view of the end of the barrel closest to the hinge shown in FIG. 10.

FIG. 10 is a catcher's view of the barrel part of the baseball wrist trainer showing the rubber band groove.

FIG. 11 is a view of the end of the barrel of the baseball wrist trainer showing the rubber band groove.

FIG. 12 is a catcher's view of the lateral cross-section of the barrel shown in FIG. 1.

FIG. 13 is a pitcher's view of a lateral cross-section of the barrel shown in FIG. 1.

FIG. 14 is a lateral cross-section of the bat handle.

FIG. 15 is a view of the bottom of the bat handle.

FIG. 16 is a view of the bat handle.

FIG. 17 is a view of end of the bat handle closest to the hinge.

FIG. 25 is lateral cross-section of the barrel collar of FIG. 1.

FIG. 26 is a view of the barrel collar of FIG. 1.

FIG. 27 is a perspective drawing of the barrel collar of FIG. 1.

FIG. 28 is a view of the hinge cover of FIG. 4.

FIG. 29 is a view of the rubber band.

FIG. 30 is lateral cross-section of the female hinge body shown in FIG. 1.

FIG. 31 is a view of end of the female hinge body closest to the barrel of FIG. 32.

FIG. 32 is a view from above of a lateral cross-section of the female hinge body shown in FIG. 4.

FIG. 33 is a view of end of the female hinge body closest to the bat handle of FIG. 32.

FIG. 34 is a catcher's view of the female hinge body shown in FIG. 4.

FIG. 35 is a view of the female hinge body for hinged attachment for golf.

FIG. 36 is a view of the female hinge body shown in FIG. 32.

FIG. 42A is a view of a golfer at address showing how the golf specific wrist trainer would work with the same ninety degree angle as shown FIG. 40A.

FIG. 42B is a view of a golfer at address showing how the golf specific wrist trainer would work with the same ninety degree angle as shown FIG. 40B.

FIG. 42C is a view of a golfer at address showing how the golf specific wrist trainer would work with the same ninety degree angle as shown FIG. 40C.

FIG. 42D is a view of a golfer at address showing how the golf specific wrist trainer would work with the same ninety degree angle as shown FIG. 40D.

FIG. 43 shows the basic components of the golf specific wrist trainer as used for golf training.

FIG. 44 is a perspective view of the bat ninety-degree rotator male hinge piece showing how the connector for lower shaft to male member fits into it.

FIG. 45 shows the spring pin.

FIG. 46 shows one example of how the hinged attachment for golf can be fastened to the golf specific wrist trainer.

FIG. 47 shows a view of how the golf specific wrist trainer with the hinged attachment for golf would look taken from behind the golfer shown in FIG. 42C.

FIG. 48A shows a cross-sectional view of how the hex nut would be attached in FIG. 42A.

FIG. 48B shows a cross-sectional view of how the hex nut would be attached in FIG. 42B.

FIG. 48C shows a cross-sectional view of how the hex nut would be attached in FIG. 42C.

FIG. 48D shows a cross-sectional view of how the hex nut would be attached in FIG. 42D.

FIG. 49A shows a cross-sectional view of how the hex nut would attach the bat ninety-degree rotator male hinge piece to the barrel rod for a right handed batter.

FIG. 49B shows a cross-sectional view of how the hex nut would attach the bat ninety-degree rotator male hinge piece to the barrel rod for a left handed batter.

REFERENCE NUMERALS IN DRAWING

Figure 5:
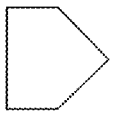
FIG. 5 is a view taken from above the baseball wrist trainer at the start of the training drill.

20 Baseball specific wrist trainer
22 Bat handle
24 Bat handle side spring pin
26 Bat handle rod
28 Bat handle collar
30 Bat handle hinge rubber band spring pin
32 Top barrel label
33 Bottom barrel label
34 Bat barrel side spring pin
36 Bat female hinge body
38 Hinge cover
40 Barrel collar
41 Bat ninety-degree rotator male hinge piece
42 Barrel rod
46 Barrel
48 Barrel rubber band post
49 Barrel rubber band post hole
50 Barrel rubber band groove
52 Barrel spring pin hole
54 Bat handle spring pin hole
56 Rubber band
57 Handle rubber band spring pin hole
58 Home plate
60 Barrel rod hinge threaded hole
62 Bat handle rod spring pin
64 Bat handle rod hinge pin hole
66 Barrel rod spring pin hole
68 Bat barrel side hinge spring pin
69 Golf specific wrist trainer
70 Target line
72 Hex screw
74 Golf clubhead
76 Machine screw
78 Ferrule
79 Connector for hinged attachment for golf
80 Female hinge body for hinged attachment for golf
81 Hinged attachment for golf threaded hole
82 Connector threaded hole
83 Connector spring pin
84 Connector for lower shaft to male member
85 Connector spring pin hole
86 Lower clubhead shaft
88 Upper shaft
89 Golf grip
90 Hinged attachment for golf
92T Top threaded hole for the hex screw to fit into male hinge member
92B Bottom threaded hole for the hex screw to fit into male hinge member
92R Right side threaded hole for the hex screw to fit into male hinge member
92L Left side threaded hole for the hex screw to fit into male hinge member
96 Lower shaft clubhead assembly
98 Elongated longer upper member for the simplest manifestation
100 Elongated shorter lower member for the simplest manifestation
106 Screw to attach elastic member to elongated shorter lower member
108 Simplest manifestation of invention

DETAILED DESCRIPTION OF THE INVENTION

Reference will now be made in detail to the present preferred embodiment of the invention, an example of which is illustrated in the accompanying drawings in which like reference characters refer to corresponding elements.

With reference to FIG. 1 and FIG. 4, the baseball specific wrist trainer 20 apparatus of the present invention is illustrated. How the apparatus is to be used is illustrated in FIGS. 5-8 and FIGS. 37-39. FIGS. 9-36 illustrate the finer points of the individual parts of the apparatus.

Figure 6:
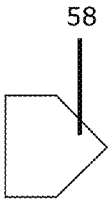
FIG. 6 is a view taken from above the baseball wrist trainer as the player continues to bring the trainer over the plate.
Figure 7:
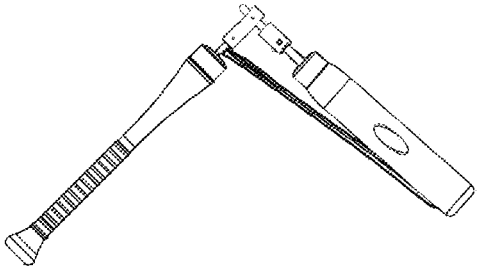
FIG. 7 is a view taken from above the baseball wrist trainer at the third part of the training drill where the baseball wrist trainer is over home plate and straightened out.
Figure 7:
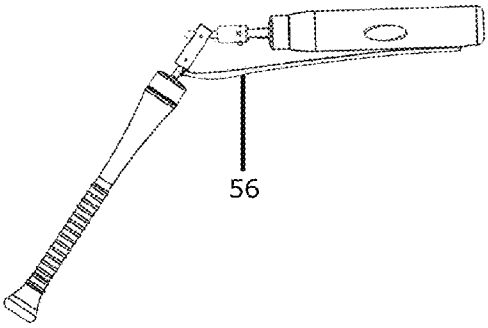
Figure 7:
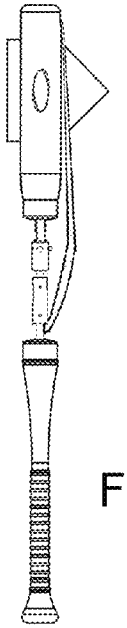

FIG. 1 is a view taken of the invention from the perspective of the pitcher in a baseball game when the wrist trainer 20 is used by a right handed batter and is over the plate as shown in FIG. 7 with the orientation of the bat handle 22 (a first elongated swing member) and the barrel 46 (a second elongated swing member) in a straight alignment, similar to a conventional baseball bat. The hinge cover 38 and the rubber band 56 are not shown in FIG. 1. FIG. 2 is a view showing the simplest manifestation of the invention 108 with the rubber band 56 (an elastic return means) causing the bat female hinge body 36 to be engaged at ninety degrees like FIG. 5. FIG. 2 also shows the elongated longer upper member for the simplest manifestation 98 which could be just a metal rod and the elongated shorter lower member for the simplest manifestation 100 which could also just be a solid metal rod, probably weighted heavier than the upper member for the simplest manifestation 98. The batter would just grip the farthest end of the elongated longer upper member for the simplest manifestation 98, and use it exactly like shown in FIGS. 37-39 and FIGS. 5-8. FIG. 3 is a view showing the simplest manifestation of the invention 108 and how it would be straightened out over home plate 58 if used by the batter in FIGS. 37-39. FIG. 3 also shows the screw to attach elastic member to elongated shorter lower member 106, as it could just be screwed into the elongated shorter lower member for the simplest manifestation 100.

FIG. 4 shows an exploded view of all of the parts of the invention besides the rubber band 56. How the spring pins fit into the various places to safely secure the parts is illustrated. The bat handle rod 26 fits into and is epoxied into the handle 22, and then the bat handle collar 28 is fitted over the handle 22 and then the bat handle side spring pin 24 is inserted into the bat handle spring pin hole 54. Once this has been put together, then the bat handle rod 26 is epoxied into the bat female hinge body 36 and secured with the bat handle rod spring pin 62, which had already had the bat handle hinge rubber band spring pin 30 inserted into the handle rubber band spring pin hole 57. The bat ninety-degree rotator male hinge piece 41 and the hinge cover 38 are secured to the hinge body 36 with the bat barrel side hinge spring pin 68. the next unit to be assembled are the parts associated with the barrel 46. The barrel rod 42 and the barrel collar 40 is then epoxied into the barrel 46 and then the bat barrel side spring pin 34 is inserted into the barrel spring pin hole 52. Once that assembly is completed, then the barrel rod 42 is put into the rotator male hinge piece 41 using the hex screw 72. For a right-handed batter, it would be inserted as shown in FIG. 49A which would keep the top barrel label 32 towards the sky, for a left-handed batter, then it would be inserted as shown in FIG. 49B which would keep the bottom barrel label 33 towards the sky, as this would keep the grain layer in the proper position for both left and right handed batters.

Figure 8:
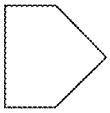
FIG. 8 is a view taken from above the baseball wrist trainer at the end of the training drill as the rubber band has caused the baseball wrist trainer to return to its ninety degree orientation.
Figure 8:
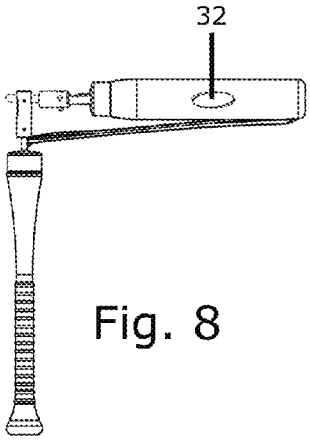
Figure 37:
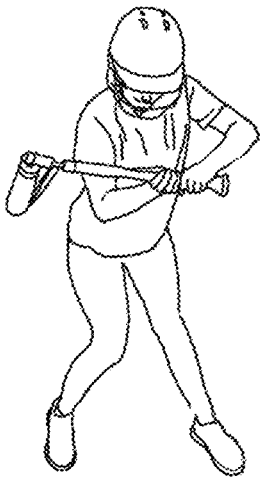
FIG. 37 is a view of a batter with the baseball specific wrist trainer at the starting point for the training drill.
Figure 38:
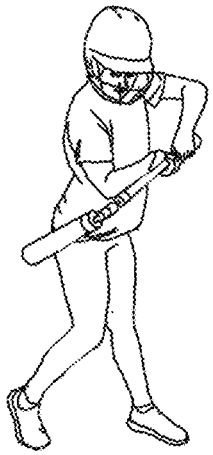
FIG. 38 is a view of a batter with the baseball specific wrist trainer at the midway point for the training drill.
Figure 39:
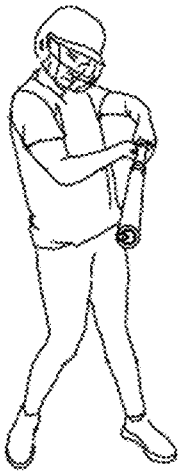
FIG. 39 is a view of a batter moving the baseball wrist trainer to the top of the home plate.

FIG. 5 shows the starting position of the wrist trainer 20 in the practice drill shown in FIGS. 37-39. There is no pronation or supination of the wrists to make the wrist trainer 20 straighten out as shown in FIG. 7. The wrists just cock and uncock along the lines of the hinge body 36 itself as shown in FIGS. 5-8. In other words, using anatomical terms, both wrists go into ulnar deviation. FIG. 6 shows the wrist trainer 20 as it moves towards the top of the home plate 58 corresponding to FIG. 38. Centripetal force is acting upon the barrel 46 to make it go to a straight line orientation with the handle 22 as shown in FIG. 7. FIG. 8 shows how the rubber band 56 causes the barrel 46 to go back to its original ninety-degree, stationary position when the rubber band 56 is attached. The batter then just keeps doing the drill illustrated in FIGS. 37-39 over and over again. This drill helps the batter to understand how the wrists act upon the bat in a proper baseball swing and also strengthens the muscles involved in this motion. The batter can also take the band 56 off of the trainer 20 and hit balls off a tee or from a pitcher with their improved swing.

FIG. 9 shows the end of the barrel 46 closest to the hinge of FIG. 10. FIG. 10 shows the barrel 46 from the catcher's view of FIG. 1. It could be made out of wood or aluminum, similar to a conventional bat. And would be around twelve to thirteen inches long and two and a half or so inches in diameter. It has a barrel rubber band groove 50 cut in-to the end to allow the band 56 to be attached to the barrel rubber band post 48 which is inserted into the barrel rubber band post hole 49. FIG. 11 shows the end of the barrel 46 with the groove 50 cut into it. FIG. 12 is a lateral cross-section of the barrel 46 shown from above the batter in FIG. 1 that points out the groove 50 and the hole 52. FIG. 13 is a lateral cross-section of the barrel 46 shown from the same perspective as FIG. 1.

Figure 18:
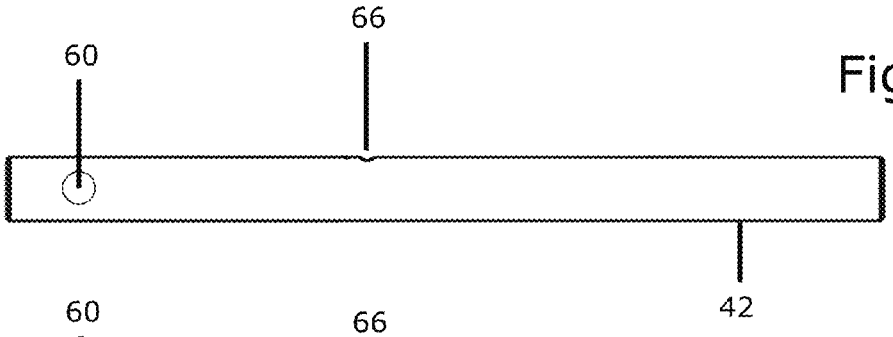
FIG. 18 is a view of the barrel rod of FIG. 4.
Figure 19:
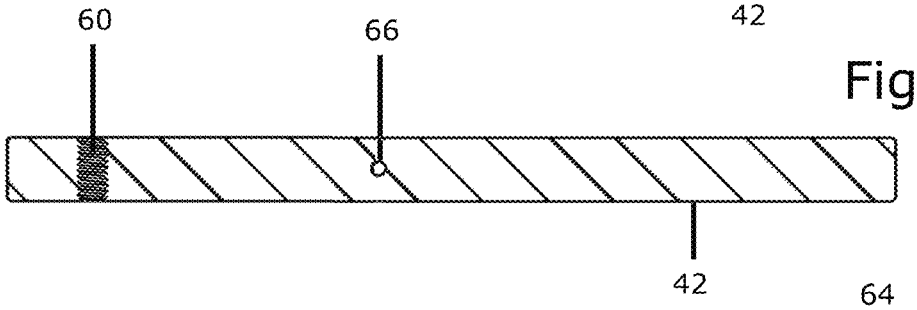
FIG. 19 is a view from above the batter of the lateral cross-section of the barrel rod of FIG. 4.

FIG. 14 is a lateral cross-section of the handle 22 shown from the perspective of the catcher in FIG. 1. It could be made out of wood or aluminum, similar to a conventional bat, and would be about seventeen inches long. FIG. 15 is a view of the bottom of the handle 22 in FIG. 16, while FIG. 16 is a view of the handle 22. FIG. 17 shows the other end of the handle 22 closest to the hinge body 36. FIG. 18 is a view of the barrel rod 42 in FIG. 4 that fits into the middle of the barrel 46 and is secured to the barrel 46 by the barrel spring pin 44 and the hinge body 36 by the spring pin 34. The rod 42 is constructed of 303 grade stainless steel and is about 8.725 inches long. FIG. 19 is a view from above FIG. 4 showing a lateral cross-section of the rod 42 and the locations of the barrel rod hinge threaded hole 60. The threaded hole 60 is approximately 0.216 inches in diameter and the barrel rod spring pin hole 66 is 0.096 inches in diameter and fits into the rotator male hinge piece 41.

Figure 20:
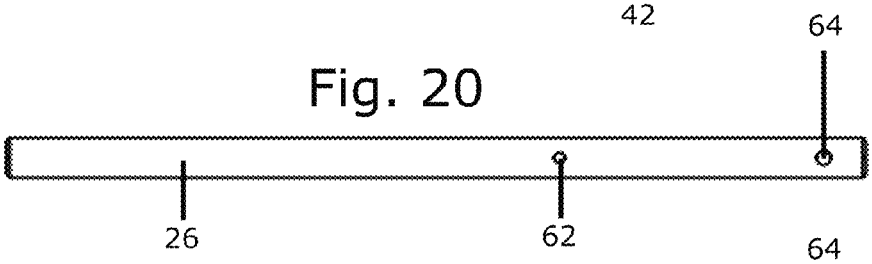
FIG. 20 is an above view of the handle rod of FIG. 4.
Figure 21:
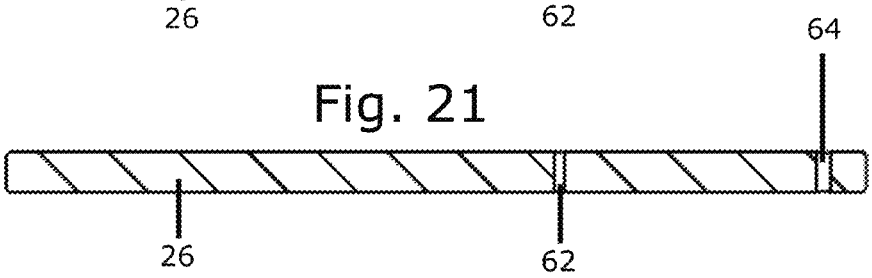
FIG. 21 is lateral cross-section of the handle rod of FIG. 4.

FIG. 20 is a view from above FIG. 4 of the bat handle rod 26 showing the spring pin hole 62 and the bat handle rod hinge pin hole 64, they connect the handle 22 to the hinge body 36. It would be made out of 303 grade stainless steel. FIG. 21 is a lateral cross-section of the rod 26 shown in FIG. 4. The hinge pin hole 64 is 0.129 inches in diameter and the spring pin hole 62 is 0.096 inches in diameter. FIG. 21 is a view from above of the lateral cross-section of the rod 26 shown in FIG. 20.

Figure 22:
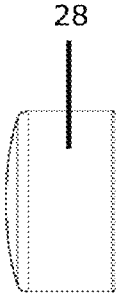
FIG. 22 is a view of the bat handle collar of FIG. 1.
Figure 23:
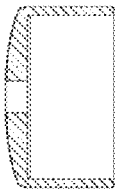
FIG. 23 is lateral cross-section of the bat handle collar of FIG. 1.
Figure 24:
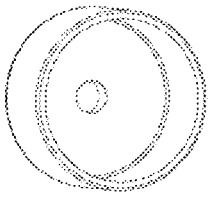
FIG. 24 is a perspective drawing of the bat handle collar of FIG. 1.

FIG. 22 is a side view of the collar 28 shown in FIG. 1. FIG. 23 is a lateral cross-section of the collar 28 shown in FIG. 22. FIG. 24 is a perspective view of the collar 28. It would preferably be made out of 6061 aluminum. The hinge assembly could be constructed of any number of materials, such as stainless steel or aluminum, and in a number of different designs which result in a hinge assembly which is preferably strong and lightweight, FIG. 25 is a lateral cross-section of the collar 40 shown in FIG. 1. FIG. 26 is a side view of the collar 40 shown in FIG. 1. FIG. 27 is a perspective view of the collar 40. FIG. 28 shows the hinge cover 38 that fits over the completed hinge and keeps the batter's fingers from getting pinched. It is best constructed of a custom fitted polyvinyl chloride material. FIG. 29 shows the typical EPDM rubber band 56 that can be bought from Alliance Rubber Company in Arkansas. Of course, other options would be combinations of gears, springs, bungee cords, exercise tubing, sheeting or pneumatic apparatus or pulleys and wires or electro magnets, variable resistance linear position sensors and switches or electrical apparatus or any combinations of those so that they hold the hinge in a backwardly angle then smoothly releases at impact with the correct hinging of wrists and forearms thru the swing and provide variable resistance for the user. Rubber bands may be preferred because of their relative simplicity and safety and provide the exact feel instructors and coaches look for.

FIG. 30 is a lateral cross-section of the hinge body 36 from the catcher's view as shown in FIG. 1. FIG. 31 is a view of the end of the hinge body 36 shown in FIG. 32. FIG. 32 is a lateral cross-section of the hinge body 36 oriented like FIG. 5. FIG. 33 shows the other end of FIG. 32. FIG. 34 is the hinge body 36 of FIG. 1 from the catcher's point of view, while FIG. 35 is a perspective view of it. FIG. 36 is a view of the hinge body 36 like FIG. 32.

FIG. 37 shows a batter at the starting point for the training drill, corresponding to how the wrist trainer 20 is aligned in FIG. 5. FIG. 38 shows a batter at the midway point for the training drill, corresponding to FIG. 6. FIG. 39 shows a batter moving the wrist trainer 20 to the top of the home plate 58 corresponding to FIG. 7. The batter just holds the wrist trainer 20 steady as shown in FIG. 39 and the rubber band 56 causes it to re-hinge as shown in FIG. 8. Once they have made it to this point, then they just repeat the drill, starting from the position shown in FIG. 37.

A bat is obviously round and should be aligned so that the impact with a baseball takes place on the side where the grain is layered, the so-called strong side. So the bat, although it can be oriented four ways with the wrist trainer 20 should be aligned as shown for the drill as shown in FIG. 7 for a right-handed batter, if made out of wood and then just the opposite for a left handed batter, so the batter can keep the grain layer of the wood in the correct orientation.

When adopting wrist trainer 20 to golf, you are presented with some special problems. Unlike the round baseball bat, the golf clubhead 74 must be in the same orientation at impact that it was at address, that is, facing the ball in all four ninety-degree orientations. Also, even though the golf swing mechanics are similar to the baseball swing, they are on a different plane. The plane of the golf swing is on an approximately forty-five degree angle to the ground, while the baseball swing is approximately on a parallel to the ground, horizontal type plane.

The instant invention uses the rotator male hinge piece 41, to solve this problem. It is specially constructed with four threaded holes for the hex screw 72 to fit it into the male hinge member 92 so that the lower shaft clubhead assembly 96 can be in the same orientation at impact that it was at address, that is, with the clubhead 74 facing the ball in all four orientations. For the golf specific wrist trainer 69, instead of the barrel rod 42, a connector for lower shaft to male member 84 is provided to connect the lower clubhead shaft 86 to the hinge body 36. The use of the band 56 is optional in any of the four orientations shown in FIGS. 42A-42D.

It was noticed that it was advantageous from a teaching standpoint to have the advantage of two hinges acting on the same shaft. The only way to do that in the past was to have a hinged club in one hand and a differently hinged club in the other hand. That was confusing to the student and costly because of needing two different clubs. So, to solve that problem the inventor designed a hinged attachment for golf 90, so that two different hinge configurations can act on the shaft at the same time. For example, to combine the two separate feels of FIG. 42A and FIG. 42C, you add the hinged attachment for golf 90 to the rotator male hinge piece 41 and obtain both feels without needing a second trainer.

After teaching golf for over twenty-eight years, it became apparent to the inventor that the best way to learn the golf swing of the tour pros is through feel. Currently, in golf, conventional instruction is more of the spoken word variety. The conventional instructor gives you a series of verbal instructions on how you are to move your body in order to accomplish the swing. Unfortunately, this has been proven to be of little help, both from a real world perspective and also as demonstrated by scientific motor-learning studies conducted at universities around the world.

The scientific community has broken down motor-learning into either internal or external cues. The internal cue is one where the coach gives instructions that refer to body movements, while the external cue is on the intended move and effect on an implement. The professors who did the studies noticed that the subjects that used the external cues experienced almost immediate advantages and these advantages lasted longer than the control subjects who used internal cues. The inventor also noticed how the external cues positively affected his golf student's progress using wrist trainer 69.

Figure 40A:
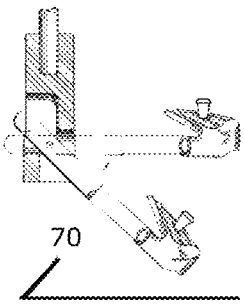
FIG. 40A is a view from behind the golfer in FIG. 42A of the golf specific wrist trainer with the same ninety degree angle as shown in FIG. 42A held perpendicular to the ground and hinged backwardly from the target.
Figure 40B:
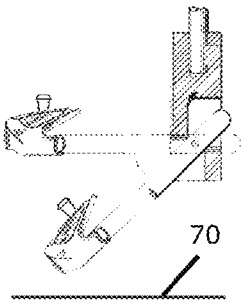
FIG. 40B is a view from behind the golfer in FIG. 42B of the golf specific wrist trainer with the ninety degree angle shown in FIG. 42B held perpendicular to the ground and hinged backwardly from the target.
Figure 40C:
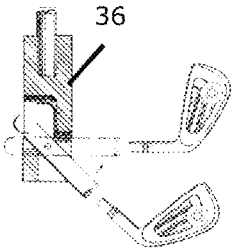
FIG. 40C is a view from behind the golfer in FIG. 42C of the golf specific wrist trainer with the ninety degree angle shown in FIG. 42C held perpendicular to the ground and hinged backwardly from the target.
Figure 40D:
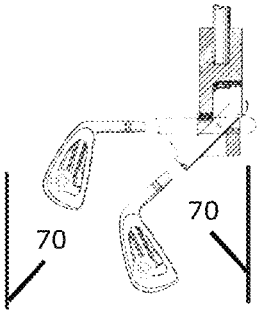
FIG. 40D is a view from behind the golfer in FIG. 42D of the golf specific wrist trainer with the clubhead hinged backwards from the target line at a ninety degree angle as shown in FIG. 42D held perpendicular to the ground and hinged backwardly from the target.
Figure 41A:
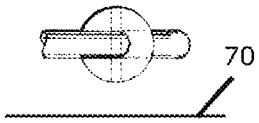
FIG. 41A is a view of the bottom of the golf specific wrist trainer with the same ninety degree angle as shown in FIG. 42A held perpendicular to the ground.
Figure 41B:
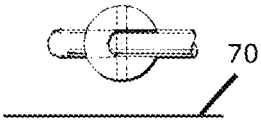
FIG. 41B is a view of the bottom of the golf specific wrist trainer with the same ninety degree angle as shown in FIG. 42B held perpendicular to the ground.
Figure 41C:
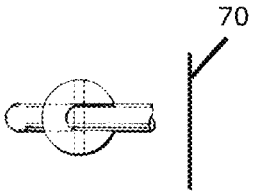
FIG. 41C is a view of the bottom of the golf specific wrist trainer with the same ninety degree angle as shown in FIG. 42C held perpendicular to the ground.
Figure 41D:
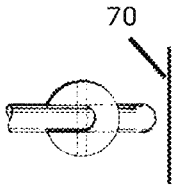
FIG. 41D is a view of the bottom of the golf specific wrist trainer with the same ninety degree angle as shown in FIG. 42D held perpendicular to the ground.

FIGS. 40A, 41A and 42A show how the golf specific wrist trainer 69 moves the clubhead assembly 96 backwards from the target at a one-way ninety-degree angle and along the same axis as the target line 70. FIGS. 40B, 41B and 42B show how the wrist trainer 69 moves the clubhead assembly 96 forward towards the target at a one-way ninety-degree angle and along the same axis as the target line 70. FIGS. 40C, 41C and 42C show how the wrist trainer 69 moves the clubhead assembly 96 upwards towards the golfer at a one-way ninety-degree angle, and the axis is perpendicular to the target line 70. FIG. 42C also shows the golf grip 89 and upper shaft 88. FIGS. 40D, 41D and 42D show how the wrist trainer 69 moves the clubhead assembly 96 downwards toward the ground at a one-way ninety-degree angle and the axis is perpendicular to the target line 70.

Figure 50A:
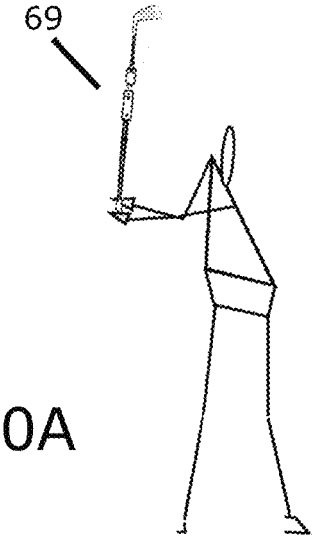
FIG. 50A shows how the golf specific wrist trainer without the rubber band straightens out at the top of the backswing when used as illustrated in FIGS. 42A, 42B and 42D.
Figure 50B:
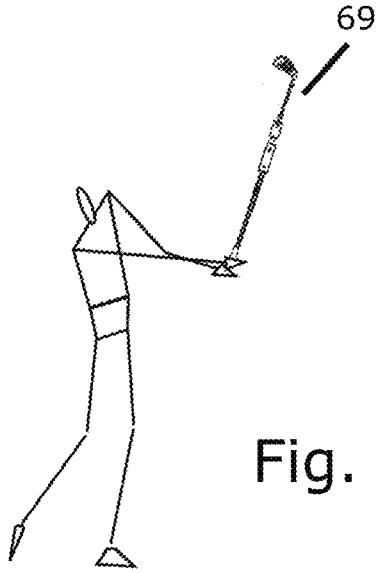
FIG. 50B shows how the golf specific wrist trainer without the rubber band straightens out at the finish of the swing when used as illustrated in FIGS. 42A, 42B and 42D.

When the golfer moves from the initial starting point shown in FIGS. 42A, 42B and 42D to the top of the backswing shown in FIG. 50A, the golf specific wrist trainer 69 straightens out and stays straight for the rest of the swing, even into the follow thru as shown in FIG. 50B. The feedback that the golfer receives is the feel of the straightening of the golf specific wrist trainer 69, which alerts the golfer to return the golf specific wrist trainer 69 to impact. In FIGS. 42A, 42B and 42D, it is possible to attach the rubber band 56 to amplify the feel of straightening. If the rubber band 56 is attached, then the shaft returns to the same 90 degree orientation at the finish that it had shown at address in FIGS. 42A, 42B and 42D.

Figure 51A:
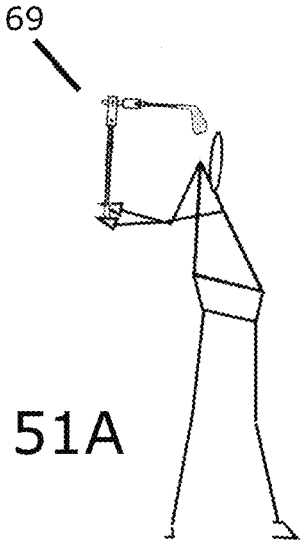
FIG. 51A shows how the golf specific wrist trainer with or without the rubber band hinges at its 90 degree orientation at the top of the backswing when used as illustrated in FIG. 42C.
Figure 51B:
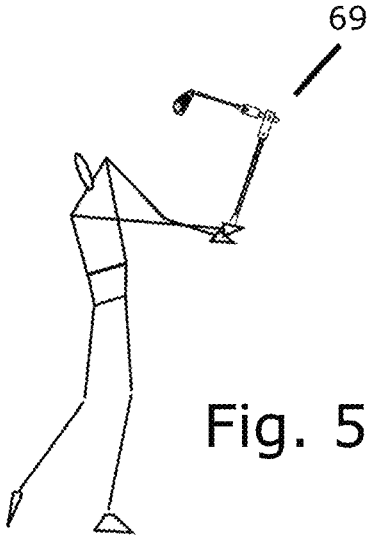
FIG. 51B shows how the golf specific wrist trainer with or without the rubber band hinges at its 90 degree orientation at the finish of the swing when used as illustrated in FIG. 42C.
Figure 52A:
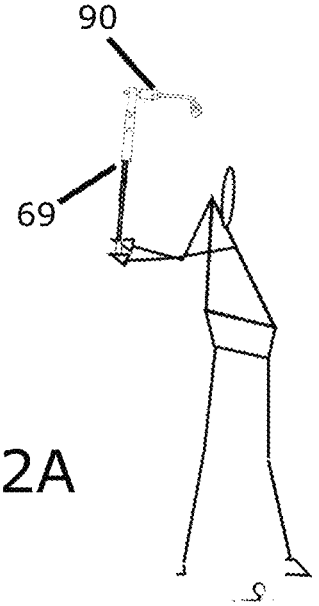
FIG. 52A shows a golfer at the top of his backswing while using the golf specific wrist trainer with the hinged attachment for golf attached to it as shown in FIGS. 46 and 47.
Figure 52B:
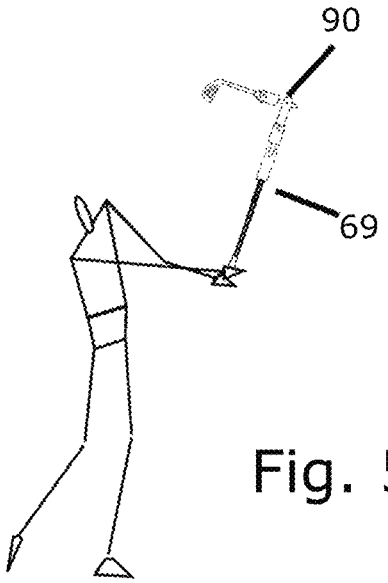
FIG. 52B shows a golfer at the finish of his swing while using the golf specific wrist trainer with the hinged attachment for golf attached to it as shown in FIGS. 46 and 47.

When the golfer moves from the initial starting point shown in FIG. 42C, the feedback that the golfer receives is the hinging of the golf specific wrist trainer 69, which alerts the golfer to return to impact. The rubber band 56 amplifies this feel of hinging. With or without the rubber band 56, the shaft returns to its 90 degree orientation at the top of backswing shown in FIG. 51A, and at the finish of the swing, shown in FIG. 51B.

FIG. 43 shows how the hinge body 36, the rotator male hinge piece 41, the connection for lower shaft to male member 84 which has a connector threaded hole 82 in it and the lower clubhead shaft 86 and the clubhead 74 and the machine screw 76 and the ferrule 78 are assembled. The hinge body 36 is connected to the rotator male hinge piece 41 by a hinge spring pin 68. The connection for lower shaft to male member 84 and the lower clubhead shaft 86 are epoxied together and also connected by the connector spring pin 83 which goes into the connector spring pin hole 85. The shaft 86 is then epoxied to the clubhead 74. Alternatively, the clubhead 74 could also be selected from any other club in a set of clubs or a training head. FIG. 44 shows how the connector for lower shaft to male member 84 fits into the rotator male hinge piece 41. FIG. 45 shows the side spring pin 24.

FIG. 46 shows a possible combination of the hinged attachment for golf 90, which is composed of the female hinge body for hinged attachment for golf 80 which is similar to the hinge body 36, but is made out of one piece and includes a connector for hinged attachment for golf 79 which includes a hinged attachment for golf threaded hole 81 that goes into the rotator male hinge piece 41 by way of a hex screw 72. Obviously, a separate lower shaft clubhead assembly 96 with a left handed clubhead would have to be made available for the left handed golfer, and that's one of the advantages of the wrist trainer 69 as you only need that attachment to provide for the use by a left-handed golfer, instead of a whole new club. FIG. 47 shows how the hinged attachment for golf 90 is configured similar to FIG. 42C, but with the added advantage of training two different feels at the same time by adding the feel of FIG. 42A.

The idea here is to have the wrist trainer 69 stay straight and the hinged attachment for golf 90 release to a one way, ninety degree angle at the top of the swing, forming a perfect L shape. This acts on the timing and tempo of the swing by having the student return the club to impact as soon as they feel the hinged attachment for golf 90 get into the perfect L shape, and on the swing plane by making sure that while performing the movement, the wrist trainer 69 stays straight and does not hinge, which keeps it on the correct swing plane.

FIGS. 48A, 48B, 48C, and 48D show how the hex screw 72 would be aligned to the bat ninety-degree rotator male hinge piece 41 in FIGS. 42A, 42B, 42C and 42D. FIG. 48A also shows the location of the top threaded hole for the hex screw to fit into male hinge member 92T. FIG. 48B also shows the location of the bottom threaded hole for the hex screw to fit into male hinge member 92B. FIG. 48C also shows the location of the right side threaded hole for the hex screw to fit into male hinge member 92R. FIG. 48D also shows the location of the left side threaded hole for the hex screw to fit into male hinge member 92L.

FIG. 49A is a cross-sectional view taken from the end of the bat of a right handed batter using the trainer 20. FIG. 49B is a cross-sectional view taken from the end of the bat of a left handed batter using the trainer 20.

FIGS. 50A through 52B illustrate the golf specific wrist trainer 69 with hinge arrangement 90 for the golf swings shown and described with the respect to FIGS. 42A through 42D, as further explained above.

FIGS. 50A through 52B illustrate the golf specific wrist trainer 69 with hinge arrangement 90 for the golf swings shown and described with the respect to FIGS. 42A through 42D, as further explained above.

SUMMARY AND SCOPE

The sports wrist trainer and methods for use described above and with reference to the accompanying drawings comprise a two member hinged practice device for golf or baseball with a removable elastic return means that allows the neophyte athlete to experience and feel what had heretofore been one of the most difficult parts of the swing to master, namely, exactly how to use the wrists in the swing. In addition, this wrist swing training aid enables participants to practice their swings anywhere and at any time. With the removable elastic member is taken off, the training aid can be used to hit balls on the baseball field or on the golf course.

The subject invention provides an affordable sports wrist swing trainer with multiple hinge options that allow the trainer to be rotated and stopped, at two 180 degree positions, or four 90 degree positions, with bat barrels or training heads, that even though being rotated are oriented to impact like a normal implement, and have an elastic retraction means that returns the hinged shafts to the original, bent, starting position.

The improved sports wrist trainer of the subject invention can be used for sports that involve a swinging action. The wrist trainers are relatively inexpensive, and can be used to alternate between different training heads and/or bat barrels. They can be used by left or right handed batters by simply rotating the hinge, and by left or right hand golfers by rotating the hinge and/or with the addition of a simple attachment.

Although some embodiments are shown to include certain features, the applicant specifically contemplate that any feature disclosed herein may be used together or in combination with any other feature on any embodiment of the invention. It is also contemplated that any feature may be specifically excluded from any embodiment of the invention.

As used herein, the following terms and variations thereof have the meanings given below, unless a different meaning is clearly intended by the context in which such term is used. "A," "an" and "the" and similar referents used herein are to be construed to cover both the singular and the plural unless their usage in context indicates otherwise.

"Comprise" and variations of the term, such as "comprising" and "comprises," are not intended to exclude other additives, components, integers or steps. "Exemplary," "illustrative," and "preferred" mean "another."

Unless otherwise indicated, all numbers, dimensions, materials and so forth used in the specification and claims are to be understood as being examples and not limitations, and in any event, not as an attempt to limit the application of the doctrine of equivalents to the scope of the claims.

All methods described herein can be performed in any suitable order unless otherwise indicated herein or otherwise clearly contradicted by context. The use of any and all examples, or exemplary language (e.g., "such as") provided herein is intended merely to better illuminate the invention and does not pose a limitation on the scope of any claim. No language in the specification should be construed as indicating any non-claimed element essential to the practice of the invention.

Certain embodiments are described herein, including the best mode known to the inventor for carrying out the invention. Of course, variations on these described embodiments will become apparent to those of ordinary skill in the art upon reading the foregoing description. The inventor expects skilled artisans to employ such variations as appropriate, and the inventors intend for the invention to be practiced otherwise than specifically described herein.

By way of example and not limitation, the subject invention can be adopted for use sports that involve swinging in addition to golf, baseball and softball, a variety of elastic retraction means can be substituted for the rubber band described and illustrated, more or less than four orientations for the one way hinge can be substituted for the four 90 degree orientations described and illustrated, and the training aid can be employed using methods other than those specifically discussed and shown. Other similar variations in the apparatus and method of the invention will be obvious to those engaged in the art.

Accordingly, the claims include all modifications and equivalents of the subject matter recited in the claims as permitted by applicable law. Moreover, any combination of the above-described elements in all possible variations thereof is contemplated unless otherwise indicated herein or otherwise clearly contradicted by context. The invention should therefore not be limited by the above described embodiment, method, and examples, but shall be deemed to include all embodiments, methods and equivalents within the scope and spirit of the invention as claimed.

The invention claimed is:

1. A sports wrist trainer comprising:

a first elongated swing member with grip at one end only;

a second elongated swing member with head at one end only;

a one way 90 degree hinge joining the non-grip end of said first swing first member to the non-head end of said second swing member; and an elastic return means removably attached to said first and second swing members that return said members to a bent orientation from a straight orientation.

2. The sports wrist trainer of claim 1 used for training golf swings wherein said elongated swing members are shafts and further comprising a clubhead attached to the head end of said second swing member.

3. The sports wrist trainer of claim 2 wherein the clubhead is selected from a variety of different sized and shaped clubs and is removably attached to the head end of said second swing member.

4. The sports wrist trainer of claim 1 used for baseball wherein said first elongated swing member is a bat handle and said second elongated swing member is a bat barrel.

5. The sports wrist trainer of claim 1, wherein said removable elastic return means is a rubber band one end of which is attached to the second swing member towards its head end and the other end of which is attached to the first swing member towards its non-grip end.

6. The sport wrist trainer of claim 1 wherein said hinge is rotatable 360 degrees about the longitudinal axis of an elongated swing member.

7. The sports wrist trainer of claim 6 wherein said rotating hinge further comprises one or more stops that releasably lock said hinge in a fixed position preventing rotation of said hinge during use of said wrist trainer.

8. The sports wrist trainer of claim 7 wherein there are four stops each 90 degrees of rotation from the next.

9. The sports wrist trainer of claim 7, wherein there are two stops each 180 degrees of rotation one from the other.

10. The sports wrist trainer of claim 7, wherein said rotating hinge comprises an outer body that is rotatable around an inner body, and wherein said stop comprises a bore traversing the outer and inner bodies, and a bolt which, when inserted into said bore, prevents said hinge from rotating.

11. The sports wrist trainer of claim 1 further comprising a second one way 90 degree hinge attached to the first one way 90 degree hinge such that one of the one way 90 degree hinges is attached to non-grip end of said first elongated swing member and the other one way 90 degree hinge is attached to the non-head end of the second elongated swing member.

12. A method for learning proper sports swing technique comprising the steps of:

gripping a sports wrist training apparatus having a first elongated swing member with grip at one end only, a second elongated swing member with head at one end only, a one way 90 degree hinge joining the non-grip end of said first swing first member to the non-head end of said second swing member, and an elastic return means removably attached to said first and second swing members that return said members to a bent orientation from a straight orientation;

back swinging said training apparatus upwards causing said hinged swing members to form a 90 degree angle relative to one another;

returning said training apparatus downwards causing the non-hinged ends of said swing members to extend away from one another at the bottom of said return swing; and continuing said return swing upwards causing said hinged swing members to reassume said 90 degree configuration.

13. The method of claim 12 used to hit balls, further comprising hitting a ball with the head end of said apparatus during the step of returning said training apparatus downward.

14. The method of claim 12, comprising the further steps of removing said elastic return means prior to gripping and swinging said apparatus.

15. The method of claim 14 used to hit balls, further comprising hitting a ball with the head end of said apparatus during the step of returning said training apparatus downward.

16. The method of claim 12, wherein said method is repeated and said hinge of said apparatus is rotatable 360 degrees about the longitudinal axis of said elongated members and the said head member is rotated at 90 degree intervals relative to said grip member between swings.

17. The method of claim 12 wherein said apparatus has a second one way 90 degree hinged attached to said first one way 90 degree hinge.

18. The method of claim 12 wherein said first swing member of said apparatus is a bat handle and second swing member is a bat barrel and said method is used for learning proper bat swing technique.

19. The method of claim 12 wherein said first and second swing members of said apparatus are shafts of a golf club and a clubhead is attached to the head of said second swing member and said method is used for learning proper golf swing technique.

20. The method of claim 19 said apparatus further comprising a variety of clubheads and wherein said user alternatively attaches different clubheads to the head end of said second swing member and swings said apparatus, alternatively, with the different clubheads.

* * * * *